US006264463B1

(12) United States Patent
Sung

(10) Patent No.: US 6,264,463 B1
(45) **Date of Patent: *Jul. 24, 2001**

(54) DOUBLE-TRIGGER CHILD-RESISTANT UTILITY LIGHTER

(76) Inventor: Kil Yong Sung, 1434 Atherton Cir., Fullerton, CA (US) 92833

( * ) Notice: Subject to any disclaimer, the term of this patent is extended or adjusted under 35 U.S.C. 154(b) by 0 days.

This patent is subject to a terminal disclaimer.

(21) Appl. No.: 09/477,022

(22) Filed: Jan. 3, 2000

Related U.S. Application Data

(63) Continuation of application No. 09/276,884, filed on Mar. 26, 1999, now Pat. No. 6,010,328.

(51) Int. Cl.[7] ..... F23Q 2/00
(52) U.S. Cl. ..... 431/153; 431/255
(58) Field of Search ..... 431/153, 255, 431/277; 222/153.14

(56) References Cited

U.S. PATENT DOCUMENTS

| | | | |
|---|---|---|---|
| 2,520,328 | 8/1950 | Nissen . | |
| 4,859,172 | 8/1989 | Nitta . | |
| 4,904,180 | 2/1990 | Nitta . | |
| 5,090,893 | 2/1992 | Floriot . | |
| 5,145,358 | 9/1992 | Shike et al. . | |
| 5,228,849 | 7/1993 | Frigiere . | |
| 5,462,432 | 10/1995 | Kim . | |
| 5,472,338 | 12/1995 | Ansquer . | |
| 5,538,417 | 7/1996 | Chan . | |
| 5,558,514 | 9/1996 | Ansquer . | |
| 5,655,901 | 8/1997 | Makoto . | |
| 5,829,963 | 11/1998 | Ichikawa . | |
| 5,833,448 | 11/1998 | Doucet et al. . | |
| 6,050,811 * | 4/2000 | Stein | 431/153 |

* cited by examiner

*Primary Examiner*—Sara Clarke
(74) *Attorney, Agent, or Firm*—Trojan Law Offices

(57) ABSTRACT

A safety mechanism in a utility lighter comprising a safety trigger that slides and rotates a fuel-release lever such that fuel is released, wherein said safety trigger has a space through it that is parallel to the safety trigger's longitudinal axis, an undersurface that moves in unison with the sliding section of a piezoelectric unit, an operation section that protrudes from the lighter housing and has a slightly curved surface, and extension tabs that help guide it along its sliding path, an ignition trigger which is located within said space through said safety trigger and activates the piezoelectric unit, said ignition trigger being capable of sliding relative to said safety trigger and having an operation section and an opposing end, wherein the operation section of said ignition trigger protrudes from said operation section of said safety trigger, and said ignition trigger is in contact with the sliding section of said piezoelectric unit, and a projection that interferes with an edge of said safety trigger, wherein the projection is fixedly attached to an inner surface of the lighter housing and extends in a direction that is perpendicular to the longitudinal axis of said lighter.

4 Claims, 4 Drawing Sheets

DOUBLE-TRIGGER CHILD-RESISTANT UTILITY LIGHTER

This invention is a continuation application of U.S. patent application Ser. No. 09/276,884 filed on Mar. 26, 1999, now U.S. Pat. No. 6,010,328.

BACKGROUND OF INVENTION

1. Field of Invention

This invention relates to a utility lighter which contains a double-triggering safety mechanism, wherein normal operation of the lighter by pressing only the safety trigger will not produce any sparks and wherein operation of both the safety trigger and an ignition trigger will produce a spark and a flame.

2. Background of the Invention

Utility lighters are very useful and have become quite prevalent in modern times. Utility lighters of the type described herein generally contain a handle and an elongated lighting rod. The shape and operation of utility lighters allow for several advantages over normal means of producing a flame. Most significantly, due to the elongated nature of the lighting rod, utility lighters enable the operator to stand a safe distance away from the object to be ignited before actuating the lighter, thus avoiding a large number of potential accidents. In addition, utility lighters allow a flame to be produced in hard-to-reach or narrow places, where the human hand holding a match would not normally fit. Still, in the hands of children, or others who do not know how to safely and properly operate the lighter, such lighters are as dangerous as any other spark and/or flame-producing device. Therefore, a need has been realized to equip utility lighters with safety features that minimize accidental or improper use by inexperienced persons, especially young children.

Many inventions have been created to address this safety-related concern. Generally, these inventions have sought to introduce safety mechanisms that disable automatic operation of either the spark-generation and/or the fuel-release function of the lighter. For example, some utility lighters provide for a blocking mechanism, where the actuating trigger is blocked from moving the required distance for a spark to be generated. In these lighters, the locking mechanism is normally de-activated by sliding an "on/off" switch to the "on" position, or by other means, so as to remove the impediment from the actuating trigger's operating path.

Although utility lighters of the type described above provide some level of safety, there is much room for improvement. Specifically, in these lighters, once the locking means (e.g., the on/off switch) is disabled, the lighter remains in the unlocked state until the locking mechanism is activated again. Therefore, if the operator disables the locking mechanism in order to use the lighter, and then forgets to re-lock the lighter, the safety feature of the lighter is rendered useless, until the locking mechanism is again activated.

In order to address this problem, some inventions have introduced locking mechanisms that are activated automatically after each use of the lighter. In general, this improvement has alleviated some of the fears associated with leaving the lighter in an unlocked, operable position after the operator has finished using the lighter. However, one disadvantage of such utility lighters is that their operation is usually cumbersome. Frequently, in order to use such automatic-locking utility lighters, the operator must use more than one finger, and sometimes more than one hand, to perform several functions simultaneously. As such, loss of ease of use is the price that is paid for any additional amount of safety that might be achieved.

Other inventions have attempted to address the safety-related issues by impeding not the operation of the trigger, but that of the fuel-release mechanism. Of course, a utility lighter containing such a mechanism would inhibit flame generation in the locked position as no fuel would be released until the locking mechanism has been deactivated. However, in these types of lighters, nothing prevents a spark from being generated. As such, the safety goals are only partially met in these types of lighters since young children handling the lighter could still create fires by operating the lighter in close proximity to a source of fuel or near carpets, paper, or other flammable material. In addition, the same disadvantages that were discussed above with respect to trigger-locking mechanisms apply equally well to fuel-release disabling mechanisms.

Therefore, there is a need for a device that not only achieves the stated safety goals, but also is amenable to operation with relative ease. The invention described herein offers such a combination. The invention requires that an ignition trigger, located in a cavity within the safety trigger, be depressed simultaneously with the safety trigger before a flame can be produced. In this way, young children are coaxed into believing that they can operate the lighter in the usual way, i.e., by pressing the safety trigger. However, such operation will produce neither a spark nor a flame. Moreover, given the relatively small size of the ignition trigger, operation of this trigger requires an amount of strength and pulp that are rarely found in the fingers of young children. At the same time, due to the placement of the ignition trigger, simultaneous operation of both the safety trigger and the ignition trigger requires use of only one finger, so that operation of the lighter by the intended adult user is no different from operation of a lighter with no safety mechanism at all.

SUMMARY OF THE INVENTION

The primary object of this invention is to provide a safety mechanism for utility lighters so that children or inexperienced users will be less likely to inadvertently activate the lighter. Such a safety feature is especially important because young children often play with lighters as toys and because lighters have mechanically moveable parts that make them attractive to children as toys.

Another object of the present invention is to prevent the generation of not only a flame, but even a spark. As noted previously, in a lighter where only the fuel-release mechanism is inhibited in the locked state, young children playing with the lighter can still use the lighter to create sparks. Depending on the child's surroundings, this can lead to the start of accidental fires if the child is operating the lighter near paper products or any other source of flammable material.

A further object of the invention described herein is to provide an improved device for maximizing safety in utility lighters without compromising ease of use. To this end, for the intended user, the invention aims to leave operation of the utility lighter as simple as it has always been to operate a regular utility lighter with no safety feature.

The invention meets its objectives by providing an ignition trigger that must be depressed in order for a spark and a flame to be produced. The ignition trigger is placed within the lighter's safety trigger, parallel to the lighter's longitudinal axis, with a portion of the ignition trigger (i.e., the ignition trigger's operation section) extending outside of the safety trigger's operation section. Typically, a young child will attempt to activate the lighter by depressing the safety trigger only. However, when this is done, neither a spark nor a flame will be generated as the safety trigger is stopped along its path by a stopper before the spark-producing mechanism can be activated. The stopper is permanently attached to the inner surface of the lighter housing shell, so that it cannot be removed out of the safety trigger's path. As such, repeated operation of the trigger by a child will yield the same unsuccessful results.

The only way to activate the lighter is to depress the ignition trigger. When this is done, initially, the ignition trigger and the safety trigger will move towards the back end of the lighter in unison. However, when the stopper engages the safety trigger, the operator must continue to depress the ignition trigger until the spark-producing mechanism is activated. This is a simple, yet effective concept. Nevertheless, it is a concept that a young child operating the lighter must recognize and grasp before he or she can successfully operate the lighter. In most cases, the child will not recognize the usefulness of the ignition trigger and will abandon the lighter after several unsuccessful attempts.

Moreover, even if a child does attain an appreciation for the interrelationship between the ignition trigger, the safety trigger, and the production of a flame, he/she will still have difficulty activating the lighter. The portion of the ignition trigger that is exposed (i.e., the ignition trigger operation section) is small relative to the size of the safety trigger. As such, it is more difficult to fully depress the ignition trigger than if the operator needed to depress only the larger, more-easily reachable, safety trigger. Thus, the single finger of a young child will not be able to fully depress the ignition trigger. Moreover, because of the smaller size and location of the ignition trigger, a child cannot use a plurality of fingers to try and depress the ignition trigger. As such, the strength needed to depress the ignition trigger, and the lack thereof in young children, itself acts as a deterrent in the present invention.

Furthermore, in one embodiment, the lighter can be constructed in such a way that, in order for the lighter to be successfully operated, the ignition trigger would have to be pressed in far enough so that the ignition trigger's operation section travels just past the safety trigger's operation section. In order to achieve this task, the operator's finger must have enough pulp to depress the ignition trigger past and into the safety trigger's body. While an adult operator can easily perform this procedure, a child operator will have difficulty doing so. Hence, again, the structural configuration of the safety mechanism of the present invention would act as a deterrent to use by young children.

Finally, as can be understood from the above description, the invention disclosed herein achieves its safety objectives without making operation of the lighter any more cumbersome than a regular utility lighter with no safety feature. Specifically, the ignition trigger is shaped and positioned in such a way that operation of the lighter is very simple in experienced hands. An adult user familiar with the operation of utility lighters need use only one finger and activate the lighter as he or she would normally. This allows the user to operate the lighter in a safe, yet non-complicated manner.

This and other advantages of the present invention will become more apparent through the following description of the drawings and detailed description of the preferred embodiment.

DETAILED DESCRIPTION OF THE PREFERRED EMBODIMENT

Figure 1:
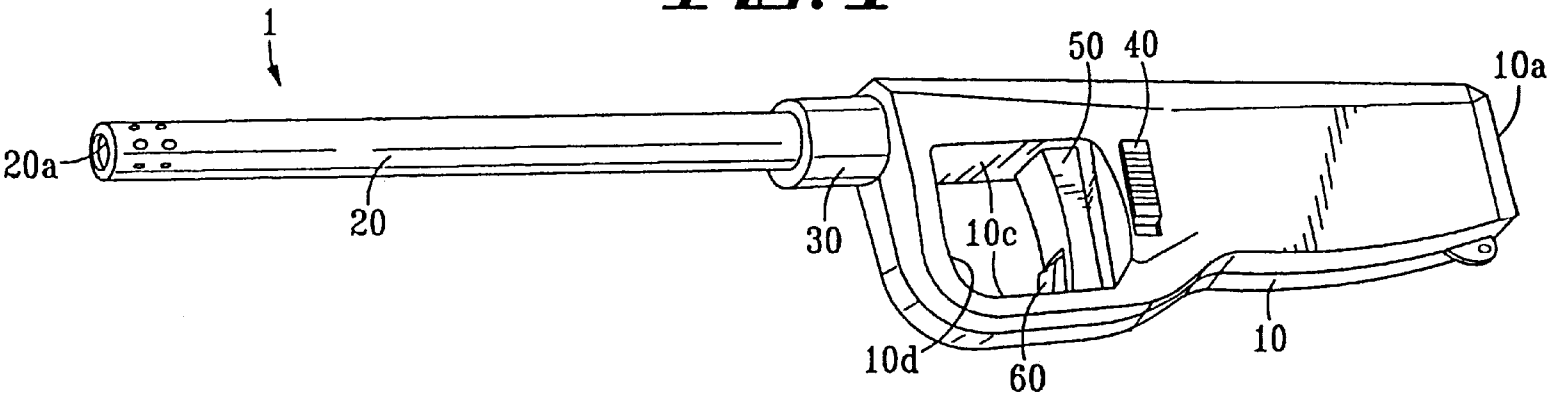
FIG. 1 is a perspective view showing an embodiment of a double-trigger child-resistant utility lighter according to the present invention.

A general description of the piezoelectric utility lighter (1) will be provided before presenting a detailed description of the improvement in the safety feature that constitutes the invention.

As shown in FIGS. 1–8, the primary elements of the utility lighter (1) include a lighter housing (10), a lighting rod (20) attached to the forward end of the lighter housing via engagement means, a support ring (30) which slides over the overlapping portions of the lighter housing and lighting rod, an on/off switch (40), a safety trigger (50), an ignition trigger (60), a stopper (70) which acts to prevent motion of the safety trigger, a piezoelectric unit (80), a fuel-release lever (90) that translates the motion of the safety trigger to open a fuel valve, and a fuel tank (100)

Figure 2:
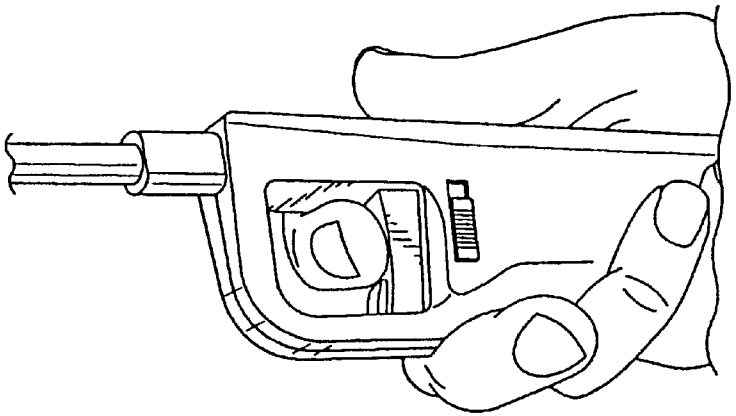
FIG. 2 is a perspective view showing the manner in which a utility lighter is normally held by the user.
Figure 5:
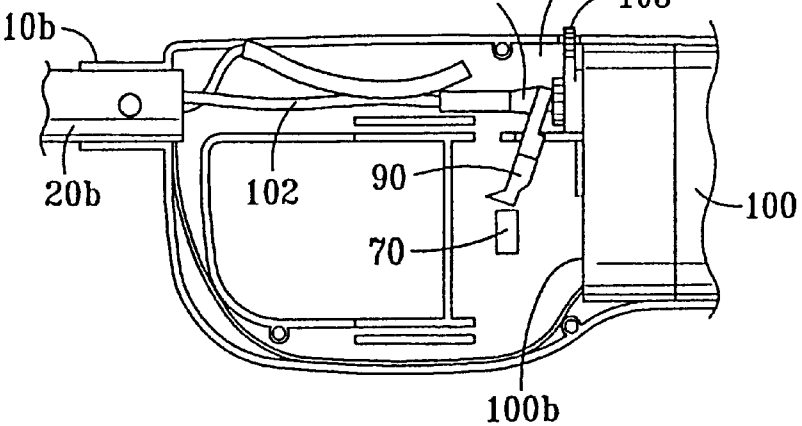
FIG. 5 is a sectional view illustrating the relative positions of the stopper, the safety trigger, and the fuel tank.
Figure 7:
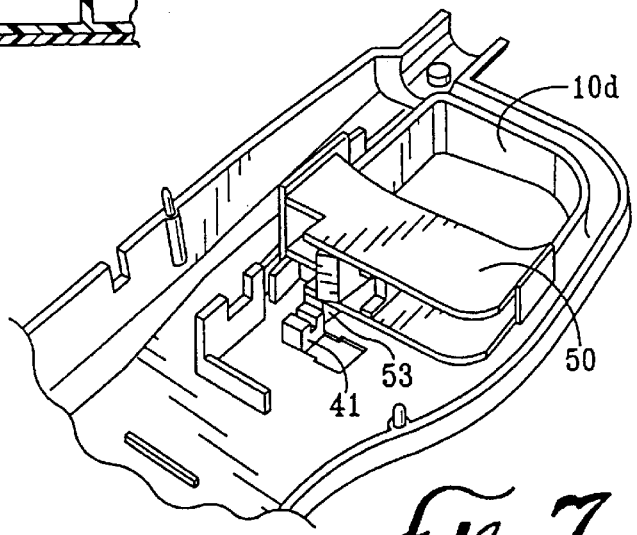
FIG. 7 is a sectional view showing the relative position of the on-off switch and the safety trigger.

The lighter housing (10) is comprised of two shells, cut along the longitudinal axis of the lighter (1). FIG. 5 shows one of these shells, and FIG. 7 shows the other. The lighter housing (10) has a back end **(10*a*) and a forward end (10*b*), where the forward end is equipped with engagement means (not shown) to engage a lighting rod (20). As shown in FIG. 2, the lighter housing contains two horizontal edges (10*c*) and a vertical edge (10*d*) which define a finger hole through which the user inserts his/her finger in order to operate the lighter (1)**.

The lighting rod (20), which typically has a cylindrical cross section, has a free end **(20*a*) which constitutes the tip of the lighter (1) and an engagement end (20*b*) which connects to the forward end (10*b*) of the lighter housing. Where the forward end (10*b*) of the lighter housing and the engagement end (20*b*) of the lighting rod overlap, there is provided a support ring (30)** which slides over and maintains the lighter housing-lighting rod combination.

The lighter (1) is equipped with a fuel tank (100) near the back end **(10*a*) of the lighter housing (10). The fuel tank (100) has a bottom portion (100*a*) facing the back end (10*a*) of the lighter housing, and a top portion (100*b*) pointing towards the forward end (10*b*) of the lighter housing. A fuel-release valve (101) is attached to the top portion (100*b*) of the fuel tank. This valve is spring loaded so that it is normally urged to the closed position. The valve is also provided with a gas tube (102) which extends through the lighting rod (20) and to a discharge nozzle (not shown) at the free end (20*a*) of the lighting rod. The valve is opened via the operation of a fuel-release lever (90). Finally, a flame-adjusting wheel (103) is provided on the valve (101)** which can be turned to adjust the amount of fuel released and, thus, the height of the resultant flame.

The next element of the lighter (1) is a piezoelectric unit (80). This unit is fitted within the top portion (100*b*) of the fuel tank and protrudes from said top portion. The lower section of this unit which is fitted within the top portion (100*b*) of the fuel tank constitutes the piezoelectric housing (81), and the upper section of the unit (80) constitutes the sliding section (82). Operation of the piezoelectric unit (80) creates an electric discharge that is carried to the free end (20*a*) of the lighting rod via wire (84); a metal sheet or wire (85), connecting the piezoelectric unit (80) with the engagement end (20*b*) of the lighting rod completes the electric circuit.

One of the primary elements of the safety-related invention is a safety trigger (50). Safety trigger (50) is slidably mounted between the two shells of the lighter housing (10). As in conventional utility lighters, the safety trigger (50) is allowed to slide back and forth along the longitudinal axis of the lighter (1). In order to help guide the safety trigger (50) along its path, the safety trigger contains flanges (51) on its top and bottom sides. These flanges are in close contact with, and slide along, the horizontal edges (10*c*) in order to prevent dislodging of the safety trigger (50).

The safety trigger (50) also has an undersurface (50*b*) and an operation section (50*a*), which operation section (50*a*) protrudes from the lighter housing (10) into the finger hole defined by horizontal edges (10*c*) and vertical edge (10*d*). Generally, the operation section (50*a*) has a surface that is slightly curved so as to appear concave. However, the invention described herein is amenable to different degrees of curvature for the operation section (50*a*) of the safety trigger (50).

Figure 3A:
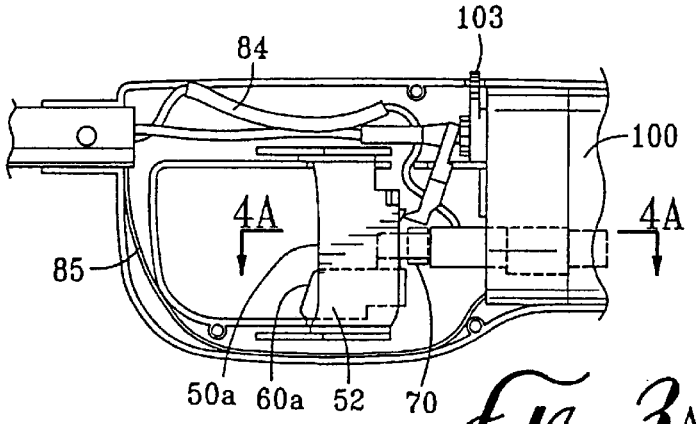
FIGS. 3A, 3B, and 3C are sectional views showing generally the operation of the safety and ignition triggers.
Figure 6:
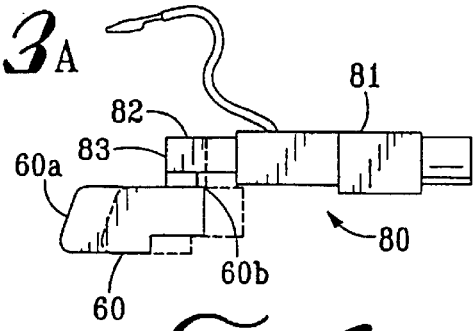
FIG. 6 is an illustration of the contact between a first embodiment of the ignition trigger and the piezoelectric unit.
Figure 3B:
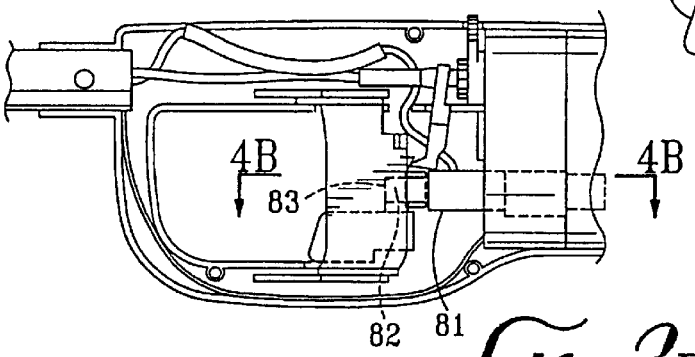
Figure 3C:
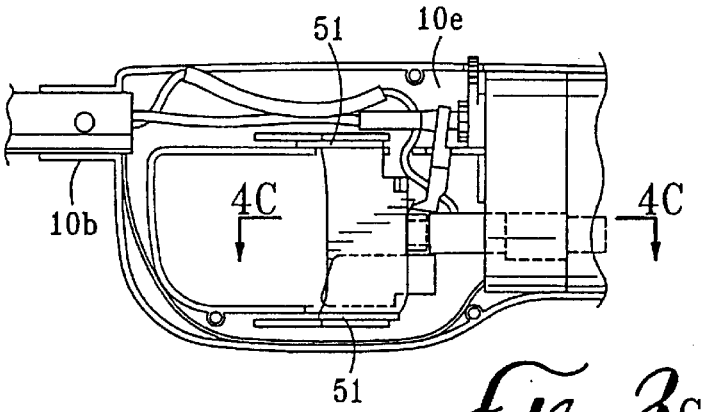
Figure 4A:
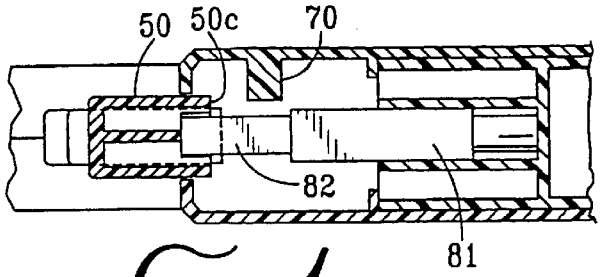
FIGS. 4A, 4B, and 4C are sectional views taken at 4A—4A, 4B—4B, and 4C—4C, respectively, of FIGS. 3A—3C.
Figure 4B:
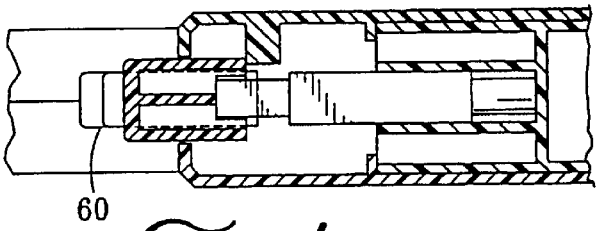
Figure 4C:
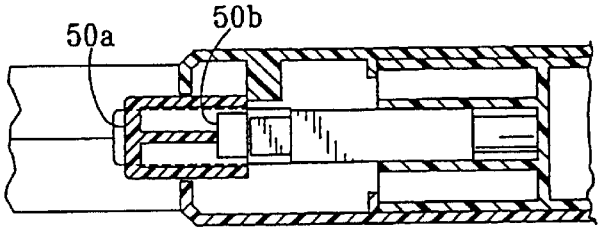
Figure 8:
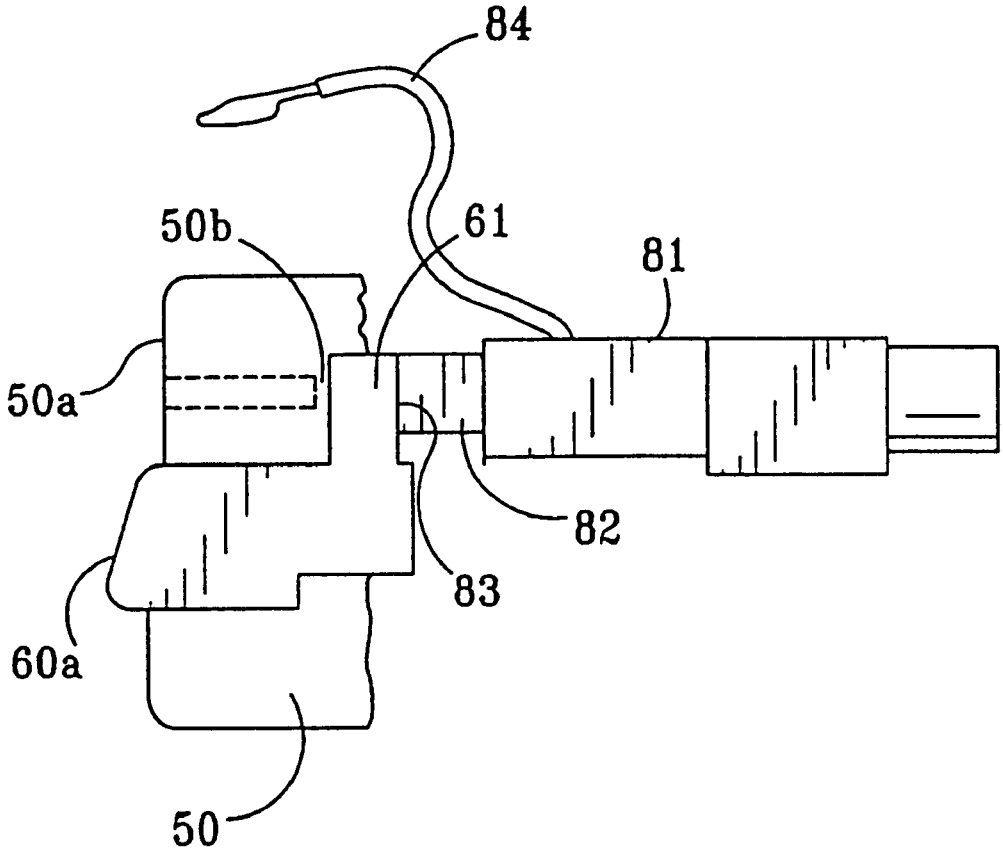
FIG. 8 is an illustration of the contact between a second embodiment of the ignition trigger and the piezoelectric unit.

The next primary element is an ignition trigger (60). Ignition trigger (60) is slidably fitted within safety trigger (50) and has an operation section (60*a*) that is exposed outside of the lighter housing (10) and the safety trigger operation section (50*a*) and is operable from the finger hole defined by horizontal edges (10*c*) and vertical edge (10*d*). The ignition trigger (60) has an opposing end (60*b*) which is in contact with the sliding section (82) of the piezoelectric unit. As shown in FIGS. 3, 4, and 8, the undersurface (50*b*) of the safety trigger (50) may be in contact with either the contact surface (83) of the sliding section (82) of the piezoelectric unit or with a vertical portion (61) of the ignition trigger (60).

The last primary element is a stopper (70). This is a projection that extends from an inner surface (10*e*) of one of the lighter housing shells, in a direction that is perpendicular to the longitudinal axis of the lighter (1). The stopper (70) functions by engaging and preventing movement of the safety trigger (50).

In the preferred embodiment, the primary elements of the safety-related invention described herein, as well as the interaction between these and the other, more conventional, elements of the utility lighter can be further defined as follows.

In the preferred embodiment, the safety trigger (50) is slidably secured between the two shells of the lighter housing (10) and is capable of sliding in a direction that is parallel to the longitudinal axis of the lighter (1). As shown in FIGS. 3, 4, and 8, the undersurface (50*b*) of the safety trigger (50) is situated such that, whenever the safety trigger (50) is depressed towards the back end (10*a*) of the lighter, the sliding section (82) of the piezoelectric unit (80) also moves in the same direction.

The undersurface (50*b*) of the safety trigger (50) is also positioned so that when it is depressed, it makes contact with the fuel-release lever (90). As shown in FIGS. 3 and 5, fuel-release lever (90) is generally L-shaped, with one end secured to the fuel-release valve (101). Depression of the safety trigger (50) causes fuel-release lever (90) to rotate, thereby releasing fuel from the fuel tank (100).

Backward motion of the safety trigger (50) is limited, however, by the stopper (70). As shown in FIGS. 3 and 4, the stopper (70) projects perpendicularly from the inner surface (10*e*) of the lighter housing shell. In the preferred embodiment, the stopper (70) is positioned so that it engages the edge (50*c*) of one side of the safety trigger (50) as the safety trigger is depressed. As explained above, the safety trigger (50) also functions to release fuel. Therefore, the stopper is positioned such that the safety trigger (50) can be moved back far enough for fuel to be released, but not far enough for the piezoelectric unit (80) to be activated.

Activation of the piezoelectric unit (80) is achieved via operation of the ignition trigger (60). As shown in FIGS. 2, 3, 4, and 8, the ignition trigger (60) is slidably held within a space (52) defined parallel to the longitudinal axis of the safety trigger (50). The ignition trigger has an operation section (60*a*) that protrudes from the operation section (50*a*) of the safety trigger (50).

Although, in the accompanying figures, the relative surface area of the operation section (60*a*) of the ignition trigger (60) is shown to be approximately between one-fourth and one-third of that of the operation section (50*a*) of the safety trigger (50), this is not a requirement of the present invention. The smaller the cross-sectional area of the ignition trigger (60), the more difficult the operation of the lighter (1) for young children. As such, the relative sizes of the operation sections (50*a*) and (60*a*) can be changed as dictated by safety requirements.

Also, in the preferred embodiment, the space (52) is located near the bottom of the safety trigger (50). The invention described herein is not limited to this feature of the embodiment either. For example, the space (52) and the ignition trigger (60) can be located near the top of the safety trigger (50), with no reduction in effectiveness of the safety feature or in ease of use of the lighter (1).

In the preferred embodiment, the sliding section (82) of the piezoelectric unit has a square or rectangular cross-section. Given this configuration, the opposing end (60*b*) of the ignition trigger (60) is in contact either with one of the sides of the sliding section (82) (FIG. 6), or with the contact surface (83) of the sliding section (82) of the piezoelectric unit (80) (FIG. 8). As shown in FIGS. 3, 4, 6, and 8, to activate the piezoelectric unit (80), the user must depress the ignition trigger (60) at its operation section (60*a*).

With the preferred embodiment as shown in the accompanying figures, the user operates the lighter (1) by depressing the operation section (60*a*) of the ignition trigger (60). Initially, the ignition trigger (60) might move back slightly. As the user continues to apply pressure towards the back end (10*a*) of the lighter, both the ignition trigger (60) and the safety trigger (50) move in unison, until the stopper (70) engages the edge (50*c*) of the safety trigger (50). As explained before, while this range of motion is sufficient to open the fuel-release valve (101) via engagement of the fuel-release lever (90), it is not enough to activate the piezoelectric unit (80). To achieve such activation, the user continues to depress the ignition trigger (60). This requires that the user have sufficient strength and pulp in his/her finger to push the operation section (60*a*) of the ignition trigger (60) to the point where the piezoelectric unit (80) will activate. This is a requirement that is rarely met in young children.

When the user releases the ignition trigger (60), the ignition trigger (60) returns to its original position by the urging force of a spring which is located in the piezoelectric unit (80). Also, as the sliding section (82) of the piezoelectric unit (80) moves towards the tip **(20*a*) of the lighter (1), the contact surface (83) of the sliding section (82) of the piezoelectric unit (80) urges the safety trigger (50) forward, thereby disengaging the edge (50*c*) of the safety trigger (50) from the stopper (70) and returning the safety trigger (50)** to its original position.

In the accompanying figures, the preferred embodiment of the lighter (1) is also equipped with an on/off switch (40). The on/off switch (40) is slidably mounted on the lighter housing (10) in close proximity to the safety trigger (50) and ignition trigger (60). As shown in FIG. 7, the on/off switch has a projection (41) which, when the switch is in the "off" position, engages a tab (53) of the safety trigger (50). In order to operate the safety trigger (50), the on/off switch is moved to the "on" position, so that projection (41) and tab (53) no longer meet.

In the "off" position, the on/off switch prevents all movement by the safety trigger (50). Therefore, in this position, depression of the safety trigger (50) will not result in the release of any fuel whatsoever as the safety trigger (50) will not cause rotation of the fuel-release lever (90) to release fuel.

Although the figures depicting the preferred embodiment include the on/off switch (40), the inventive quality of the invention described herein neither requires nor is dependent on the inclusion of this switch. That is, although the on/off switch adds an extra measure of safety to the operation of the lighter (1), it is not necessary for the safe operation of the lighter (1). As such, the invention is not to be limited by the embodiment shown in the figures and described in the description which is provided by way of example and not of limitation, but only in accordance with the scope of the appended claims.

What is claimed is:

1. A utility lighter having a safety mechanism, which utility lighter is provided with a lighter housing having two shells cut along a longitudinal axis of the lighter and a back end and a forward end, and constituting a main body of the lighter, a lighting rod with a first engagement end and a second free end, the engagement end being attached to the forward end of the lighter housing and the free end constituting a tip of the lighter, the tip of the lighter being provided with a fuel-discharge nozzle, and the main body being provided with a fuel tank, a fuel-release valve mechanism, a piezoelectric unit which has a housing, a sliding section, and a contact surface and which generates a discharge voltage that is carried to the tip of the lighter and used to ignite the fuel, a flame-adjusting wheel, which is moveable to adjust flame height and protrudes partially from the main body, a fuel-release lever having a first end, which is in contact with the fuel-release valve mechanism, and an opposing second end, the safety mechanism comprising:

a safety trigger for operating said fuel-release lever such that fuel is released, the safety trigger having a hole and a range of motion;

an ignition trigger, located in the hole of the safety trigger, for activating said piezoelectric unit; and a projection for limiting the range of motion of the safety trigger thereby preventing the safety trigger from being depressed sufficiently to activate the piezoelectric unit.

2. The utility lighter as in claim 1, wherein the safety trigger is slidably secured between said two shells of said lighter housing.

3. The device as in claim 2, wherein the safety trigger comprises means for guiding said safety trigger along a sliding path.

4. The device as in claim 3, wherein the safety trigger has an operation section that protrudes from the lighter housing.

* * * * *